US012789253B2

(12) United States Patent
Ueda

(10) Patent No.: US 12,789,253 B2
(45) Date of Patent: Nov. 10, 2026

(54) CURRENT ASSISTED SINTERING METHOD AND CURRENT ASSISTED SINTERING APPARATUS

(71) Applicant: THE JAPAN STEEL WORKS, LTD., Tokyo (JP)

(72) Inventor: Naoki Ueda, Tokyo (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 920 days.

(21) Appl. No.: 17/927,358

(22) PCT Filed: Apr. 20, 2021

(86) PCT No.: PCT/JP2021/015963
§ 371 (c)(1),
(2) Date: Nov. 22, 2022

(87) PCT Pub. No.: WO2021/256075
PCT Pub. Date: Dec. 23, 2021

(65) Prior Publication Data

US 2023/0211411 A1 Jul. 6, 2023

(30) Foreign Application Priority Data

Jun. 18, 2020 (JP) ..... 2020-105151

(51) Int. Cl.
*B22F 3/16* (2006.01)
*B22F 3/03* (2006.01)
(Continued)

(52) U.S. Cl.
CPC ..... *B22F 3/16* (2013.01); *B22F 3/03* (2013.01); *B22F 3/105* (2013.01); *B22F 3/14* (2013.01); *B22F 2003/1051* (2013.01)

(58) Field of Classification Search
CPC ..... B22F 3/105; B22F 3/16
See application file for complete search history.

(56) References Cited

U.S. PATENT DOCUMENTS 6,511,758 B1 1/2003 Kaitani
11,056,633 B2 * 7/2021 Hoch ..... B22F 7/08
(Continued)

FOREIGN PATENT DOCUMENTS

CN 1482269 A 3/2004
CN 104942289 A 9/2015
(Continued)

OTHER PUBLICATIONS

Rahaman M.; Sintering Theory and Fundamentals, ASM Handbook, vol. 7, Powder Metallurgy, 2015 (Year: 2015).*
(Continued)

*Primary Examiner* — Sally A Merkling
*Assistant Examiner* — Austin Pollock
(74) *Attorney, Agent, or Firm* — Potomac Law Group, PLLC

(57) ABSTRACT

In a current assisted sintering method according to an embodiment includes: a pressure-molding step of molding a powder compact by pressing a powder charged in a mold; a mold releasing step of releasing the powder compact from the mold; and a current assisted sintering step of forming a sintered compact by feeding an electric current through the powder compact released from the mold. In the pressure-molding step, a cylindrical mold, of which one end and the other end are opened, made of a material containing a metal is used as the mold, and the powder is pressed by a first punch inserted into the one opening and a second punch inserted into the other opening.

5 Claims, 14 Drawing Sheets

(51) Int. Cl.
*B22F 3/105* (2006.01)
*B22F 3/14* (2006.01)

(56) References Cited

U.S. PATENT DOCUMENTS

| | | | | |
|---|---|---|---|---|
| 2008/0131719 | A1* | 6/2008 | Okaniwa | B22F 7/08 428/564 |
| 2010/0155993 | A1* | 6/2010 | Aalund | B29C 67/04 425/149 |
| 2011/0318411 | A1* | 12/2011 | Luber | B29C 43/146 514/648 |
| 2016/0260542 | A1 | 9/2016 | Kohno et al. | |

FOREIGN PATENT DOCUMENTS

| | | | | | |
|---|---|---|---|---|---|
| CN | 105256159 | A | | 1/2016 | |
| CN | 105935766 | A | | 9/2016 | |
| CN | 106238732 | A | | 12/2016 | |
| CN | 107937748 | A | | 4/2018 | |
| EP | 3147918 | A1 | | 3/2017 | |
| JP | S58-130202 | A | | 8/1983 | |
| JP | 2000239707 | A | * | 9/2000 | |
| JP | 2001-329303 | A | | 11/2001 | |
| JP | 2005-097697 | A | | 4/2005 | |
| JP | 2014001427 | A | * | 1/2014 | C22C 1/045 |
| JP | 2018-021262 | A | | 2/2018 | |
| JP | 2018-044207 | A | | 3/2018 | |
| TW | 1671145 | B | | 9/2019 | |
| TW | I671145 | B | | 9/2019 | |

OTHER PUBLICATIONS

Robinson T.; "Powder Metallurgy Presses and Tooling"; ASM Handbook, vol. 7, Powder Metallurgy, p. 191-202, 2015 (Year: 2015).*

PMD; "Compacting or Pressing of Metal Powders: How is it Done?"; retrieved from the internet on Apr. 7, 2026; https://pmdistributors.com.au/compacting-or-pressing-of-metal-powders-how-is-it-done/; published on Mar. 29, 2018 (Year: 2018).*

Lampman S.; Compressibility and Compactibility of Metal Powders; ASM Handbook, vol. 7, Powder Metallurgy (Year: 2015).*

Extended European Search Report issued May 22, 2024, in European Patent Application No. 21825985.1.

"What is powder metallurgy?" Japan Powder Metallurgy Association, [online], [Search date: May 7, 2020], Internet <https://www.jpma.gr.jp/powder_m/>.

International Search Report from International Patent Application No. PCT/JP2021/015963, Jun. 8, 2021.

Office Action issued May 1, 2025, in Chinese Patent Application No. 202180043406.6.

Office Action issued Mar. 11, 2025, in Japanese Patent Application No. 2024-079506.

Office Action issued Jan. 30, 2024, in Japanese Patent Application No. 2023-064322.

Office Action issued Nov. 5, 2025, in Chinese Patent Application No. 202180043406.6.

Office Action issued Dec. 15, 2025, in Taiwanese Patent Application No. 110120868.

Office Action issued Jan. 21, 2026, in Korean Patent Application No. 10-2022-7042085.

* cited by examiner

2000 [μm]

50 [μm]

CURRENT ASSISTED SINTERING METHOD AND CURRENT ASSISTED SINTERING APPARATUS

TECHNICAL FIELD

The present invention relates to a current assisted sintering method and a current assisted sintering apparatus.

BACKGROUND ART

Patent Literature 1 discloses a current assisted sintering method in which a sintered compact is formed by feeding an electric current through a powder charged in a cylindrical mold while pressing the powder by an upper punch and a lower punch. The current assisted sintering method is also called a Spark Plasma Sintering method (hereafter referred to as an SPS method) or a Pulse Electric Current Sintering method. In the current assisted sintering method disclosed in Patent Literature 1, a sintered compact is formed through a powder charging step and a pressed current assisted sintering step.

Non-patent Literature 1 discloses a Powder Metallurgy method in which a powder compact is formed by pressing a powder charged in a mold by an upper punch and a lower punch, and then a sintered compact is formed by heating the formed powder compact at a high temperature. In the powder metallurgy method disclosed in Non-patent Literature 1, a sintered compact is formed through a powder charging step, a pressure-molding step, and a heat sintering step.

CITATION LIST

Patent Literature

Patent Literature 1: Japanese Unexamined Patent Application Publication No. 2018-044207

Non Patent Literature

Non-patent Literature 1: "What is powder metallurgy?" Japan Powder Metallurgy Association, [online], [Search date: May 7, 2020], Internet <https://www.jpma.gr.jp/powder_m/>

SUMMARY OF INVENTION

Technical Problem

In the current assisted sintering method disclosed in Patent Literature 1, the displacement (i.e., the moving distance) of the punch is large in the pressed current assisted sintering step, thus raising a possibility of an occurrence of a failure such as a powder caught in the gap between the mold and the punch being sintered. Further, since the mold and the punch are rubbed against each other under a high temperature environment, the lifespan of the mold becomes short because of, for example, the seizing up of the mold and the punch. Further, since the mold is used under the high-temperature and abrasive environment, it is necessary to select a heat-resistant alloy having wear resistance as the material for the mold and the punch, so that the manufacturing cost of the mold is high. Therefore, in the current assisted sintering method disclosed in Patent Literature 1, production costs cannot be reduced. In Non-patent Literature 1, since the heat sintering step takes time, productivity cannot be improved.

Other problems to be solved and novel features will become apparent from descriptions in this specification and accompanying drawings.

Solution to Problem

A current assisted sintering method according to an embodiment includes: a pressure-molding step of molding a powder compact by pressing a powder charged in a mold; a mold releasing step of releasing the powder compact from the mold; and a current assisted sintering step of forming a sintered compact by feeding an electric current through the powder compact released from the mold.

A current assisted sintering apparatus according to an embodiment includes: pressure-molding means for molding a powder compact by pressing a powder charged in a mold; mold releasing means for releasing the powder compact from the mold; and current assisted sintering means for forming a sintered compact by feeding an electric current through the powder compact released from the mold.

A current assisted sintering apparatus according to an embodiment includes: pressure-molding means for molding a powder compact by pressing a powder charged in a mold; mold releasing means for releasing the powder compact from the mold; current assisted sintering means for forming a sintered compact by feeding an electric current through the powder compact released from the mold; a pressure-molding unit including the pressure-molding means and the mold releasing means; a current assisted sintering unit disposed side by side with the pressure-molding unit, the current assisted sintering unit including the current assisted sintering means; and conveyance means for conveying the powder compact from the pressure-molding unit to the current assisted sintering unit.

Advantageous Effects of Invention

According to the above-described embodiment, it is possible to provide a current assisted sintering method and a current assisted sintering apparatus capable of reducing production costs.

DESCRIPTION OF EMBODIMENTS

For clarifying the description, the following description and the drawings are partially omitted and simplified as appropriate. Further, the same symbols are assigned to the same or corresponding components throughout the drawings, and redundant descriptions thereof are omitted as appropriate.

First Embodiment

Prior to describing a current assisted sintering method and a current assisted sintering apparatus according to a first embodiment, sintering methods according to comparative examples 1 and 2 will be described. Then, a current assisted sintering method according to an embodiment of the present disclosure will be described in comparison with the sintering methods according to the comparative examples 1 and 2. In this way, the features of the current assisted sintering method according to the embodiment can be clarified. After that, a current assisted sintering apparatus according to an embodiment of the present disclosure will be described.

Comparative Example 1: Powder Metallurgy Method

Figure 1:
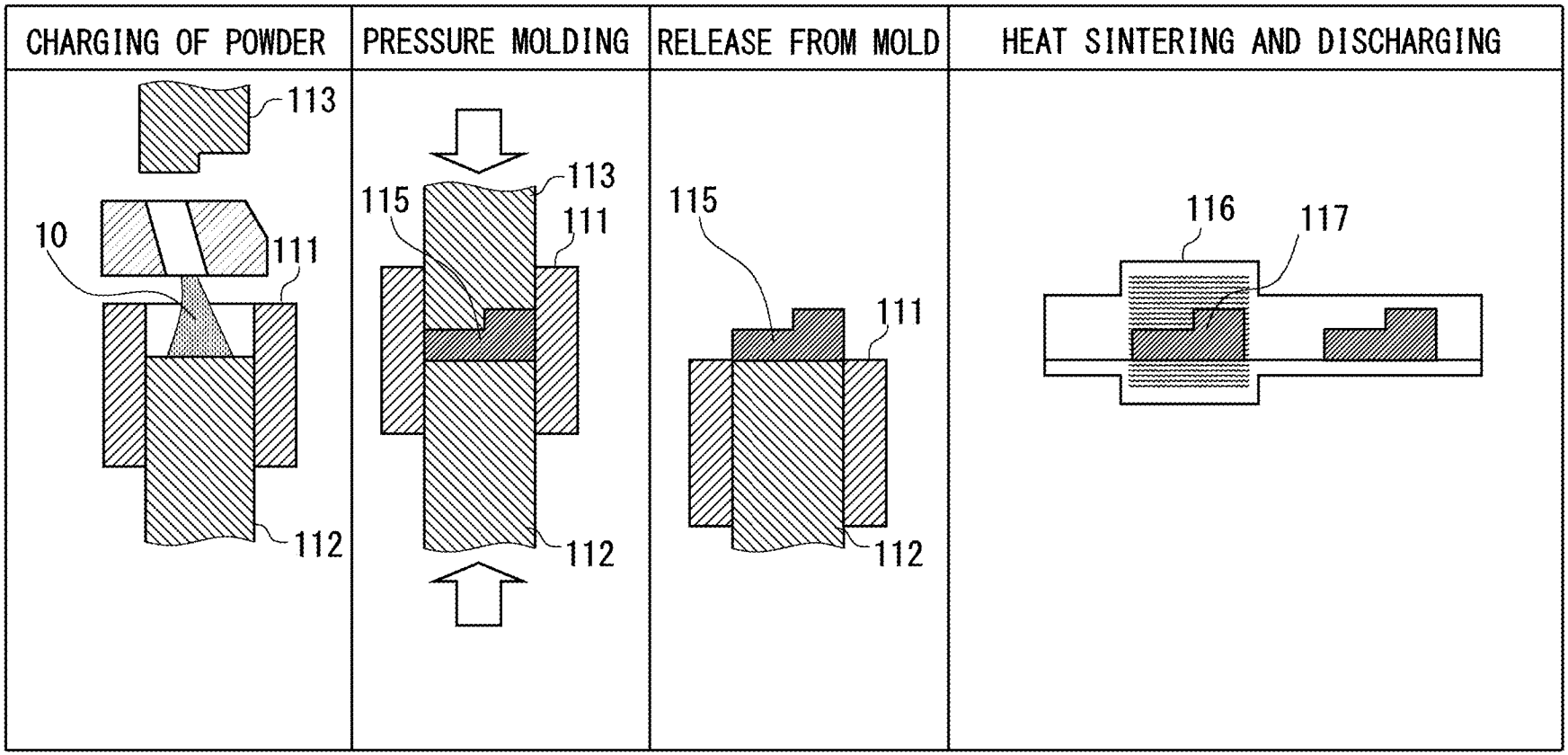
FIG. 1 is a flow sheet showing an example of a powder metallurgy method according to a comparative example 1.

As a sintering method according to a comparative example 1, a powder metallurgy method will be described. The powder metallurgy method is a method for manufacturing a high-strength material or component by sintering a powder compact, which has been formed by pressing and compacting a powder with a press, at a high temperature. FIG. 1 is a flow sheet showing a powder metallurgy method according to the comparative example 1. As shown in FIG. 1, the powder metallurgy method includes a powder charging step, a pressure-molding step, a mold releasing step, a heat sintering step, and a discharging step. In the case where the used powder 10 contains a plurality of types of substances, the method may include a powder mixing step prior to the powder charging step.

In the powder mixing step, the powder 10 is mixed. The powder 10 contains a material(s) necessary for forming a desired sintered compact. The powder 10 may contain a plurality of types of materials. The powder 10 may contain, for example, a powder of a metal such as iron, copper, aluminum, nickel, chromium, tungsten, or molybdenum, or contain an alloy steel, such as stainless steel, in which chromium or nickel is contained in iron. Alternatively, the powder 10 may contain a powder of an aluminum alloy or the like in which at least one of copper, manganese, silicon, magnesium, zinc, and nickel is contained in aluminum. Further, the powder 10 is not limited to powders of metals. That is, the powder 10 may contain an oxide such as alumina and zirconia, a nitride such as silicon nitride, a carbide such as silicon carbide, titanium carbide and tungsten carbide, bio-ceramics such as hydroxyapatite, a layered compound such as mica, or ceramics having ionic conductivity such as garnet.

Further, the formed sintered compact may be, for example, a nanomaterial, a functionally gradient material, an amorphous material, a porous material, an intermetallic compound, metallic glass, a biomaterial, a hard material, a thermoelectric conversion material, a superconducting material, a magnetic material, fine ceramics, a mold tool, a cemented carbide, a titanium alloy, a super-heat radiation material, a sputtering target material, a dielectric/electronic device material, a carbon nanotube (CNT) composite material, a carbon nanofiber (CNF) composite material, a fiber-reinforced concrete (FRC), a fiber-reinforced metal (FRM), a material used for aerospace components, or the like. In the case of the powder 10 containing a plurality of types of materials, the plurality of types of materials, which are the raw materials, have already been mixed by a mixer.

As shown in FIG. 1, in the powder charging step, the powder 10 is charged into a mold 111. The mold 111 has, for example, a cylindrical shape in which its upper end and lower end are opened. A lower punch 112 is inserted into the lower opening of the mold 111. As a result, a cavity is formed over the lower punch 112 inside the mold 111. The lower punch 112 may include a plurality of punch members. For example, the lower punch 112 may contain two punch members. Then, the powder 10 is charged into the cavity surrounded by the mold 111. An upper punch 113 is inserted into the upper opening of the mold 111, which has been filled with the powder 10. The upper punch 113 may include a plurality of punch members. For example, the upper punch 113 may contain three punch members. In the powder charging step, the packing density of the powder 10 charged in the mold 111 is, for example, about 50 [%].

In the pressure-molding step, a powder compact 115 is molded by pressing the powder 10 charged in the mold 111. Specifically, the powder 10 charged in the mold 111 is pressed by the upper and lower punches 113 and 112. The pressure (i.e., the pressing force) is, for example, 100 to 700 [MPa], or 700 [MPa] or higher. In the pressure-molding step, heat does not need to be intentionally applied. The temperature is, for example, 300 [° C.], and specifically, in a range from a room temperature to 400 [° C.]. In this way, the powder compact 115 in which the powder 10 is compressed is formed. In the pressure-molding step, the powder packing density is changed, for example, from a density lower than 60 [%] to 60 [%] or higher. For example, the powder packing density is changed to 80 [%]. In this way, the particles of the powder 10 are compacted.

In the powder metallurgy method, the mold 111 made of a material(s) containing a metal(s) is used. Therefore, it is possible to apply a high pressure in a range of 100 to 700 [MPa], or 700 [MPa] or higher. Therefore, by using the mold 111 having a cavity surface having a complicated shape, it is possible to form a powder compact 115 having a complicated shape that accurately conforms to the shape of the cavity surface of the mold 111. Further, it is possible to repeatedly manufacture powder compacts 115 having identical shapes by using one mold 111. Therefore, it is possible to manufacture a large number of powder compacts 115 having identical shapes.

In the mold releasing step, the powder compact 115 is released (i.e., removed) from the mold 111. For example, the powder compact 115, which has been formed by the pressure-molding step, is released from the mold 111 by pushing the powder compact 115 out of the mold 111 by the lower punch 112.

In the heat sintering step, the powder compact 115 is sintered. In the heat sintering step, the powder compact 115 is heated at a high temperature inside a sintering furnace 116. In the case of solid-phase sintering, the temperature is lower than the melting point of any of the components contained in the powder 10, and in the case of liquid-phase sintering, the temperature is higher than the melting point of at least one of the components contained in the powder 10. The temperature is preferably, for example, ⅔ to ¾ of the melting point, or higher than that. For example, in the case of an iron material, the temperature is about 1,000 [° C.]. As described above, in the heat sintering step, the powder compact 115 is solidified over time at a temperature at which the powder compact 115 does not melt and deform. In this way, a sintered compact 117 is formed. In this way, the particles of the powder 10 are, for example, sintered.

In the heat sintering step, the powder packing density slightly increases. The sintering furnace 116 successively heats a large number of powder compacts 115 by using moving means such as a belt conveyor.

In the discharging step, the formed sintered compact 117 is discharged (i.e., removed). In an ordinary powder metallurgy method, a series of operations including the pressure molding of the powder compact 115 in the pressure-molding step, the releasing from the mold, the conveyance, and the heat sintering by the successive sintering furnace 116 are performed in an automated manner. Therefore, by the powder metallurgy method, it is possible to manufacture a large number of components using sintered compacts 117 having complicated shapes.

The below-shown Table 1 is a table showing examples of advantages and disadvantages of the sintering methods according to the comparative examples 1 and 2, and the sintering method according to the first embodiment. As shown in the Table 1, by the powder metallurgy method according to the comparative example 1, it is possible to press-mold a powder compact 115 having a complicated shape, and thereby to form a sintered compact 117 having a complicated shape. However, the time required for sintering in the sintering furnace 116 is longer than that required for the pressure molding. For example, it takes several hours. Therefore, even if a large number of sintered compacts are manufactured in an automated manner, its productivity is limited to a certain level.

TABLE 1

| | Comparative Example 1 Powder Metallurgy | Comparative Example 2 SPS method | Example Powder Metallurgy |
|---|---|---|---|
| Advantages | Complicated shape can be formed | Time for Sintering is short | Complicated shape can be formed<br>Time for sintering is short<br>Burrs are suppressed<br>Lifespan of mold is long<br>Productivity improves |
| Disadvantages | Time for sintering is longer than that for molding<br>Productivity decreases | Complicated shape cannot be easily formed<br>Burrs are formed<br>Productivity decreases | |

Comparative Example 2: SPS Method

Figure 2:
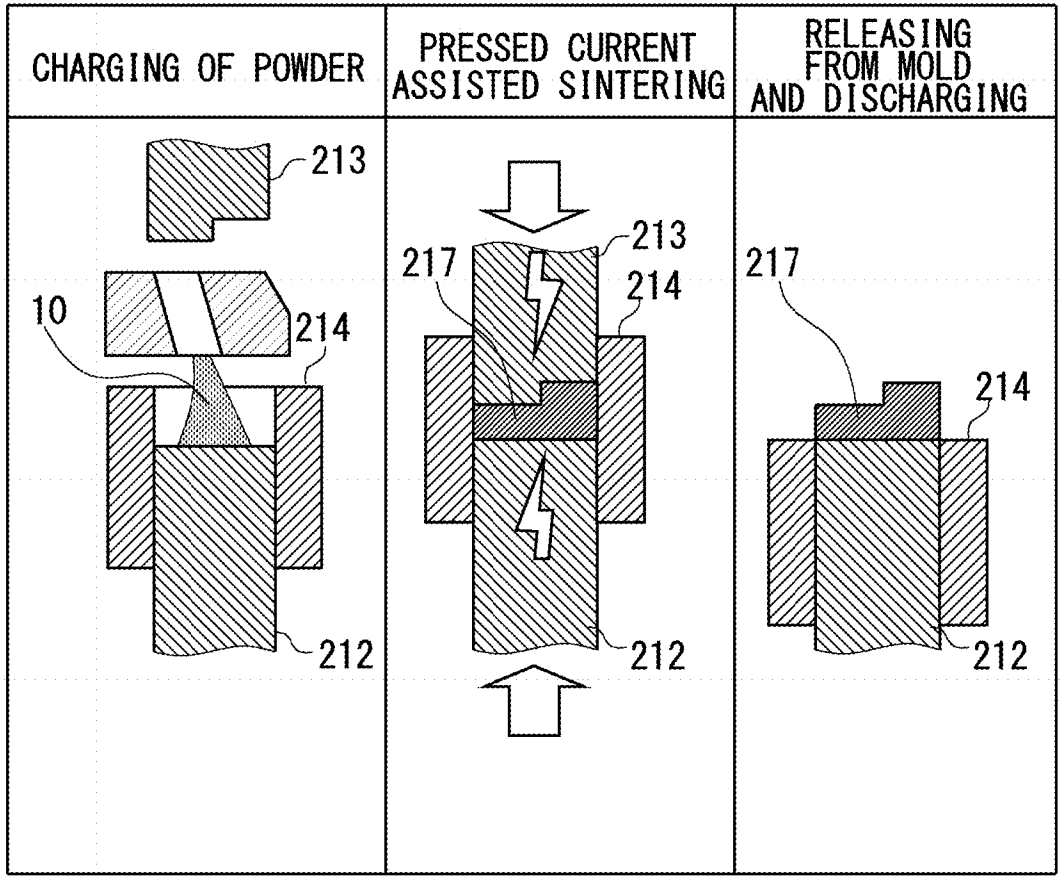
FIG. 2 is a flow sheet showing an example of an SPS method according to a comparative example 2.

An SPS method will be described as a sintering method according to a comparative example 2. In the SPS method, a powder 10 is charged into a mold made of carbon and sintering is performed by feeding an electric current through the powder 10 while pressing the powder 10, so that the sintering is performed in a short time. FIG. 2 is a flow sheet showing the SPS method according to the comparative example 2. As shown in FIG. 2, the SPS method includes a powder charging step, a pressed current assisted sintering step, and a mold release discharging step. Note that, similarly to the powder metallurgy method according to the comparative example 1, the SPS method may also include a powder mixing step prior to the powder charging step when the used powder 10 contains a plurality of types of materials.

In the powder charging step in the SPS method, the powder 10 is charged in a carbon mold 214. The powder 10 may be similar to that used in the comparative example 1. The carbon mold 214 may be, for example, a cylindrical shape in which its upper end and lower end are opened. A lower punch 212 is inserted into the lower opening of the carbon mold 214. As a result, a cavity is formed over the lower punch 212 inside the carbon mold 214. Then, the powder 10 is charged into the cavity surrounded by the carbon mold 214. An upper punch 213 is inserted into the upper opening of the carbon mold 214, which has been filled with the powder 10. In the powder charging step, the packing density of the powder 10 charged in the carbon mold 214 is, for example, about 50 [%].

In the pressed current assisted sintering step, an electric current is fed through the powder 10 charged in the carbon mold 214 while pressing the powder 10 by the upper and lower punches 213 and 212. In this way, a sintered compact 217 can be formed in a short time. In the SPS method, the carbon mold 214 containing carbon is used to feeding an electric current through the powder 10. Since a highly strong mold 111, which can be used in the powder metallurgy method, cannot be used, it is difficult to apply a high pressure to the powder 10. The pressure is, for example, about 20 [MPa]. In the pressed current assisted sintering step, the powder packing density is changed, for example, from 50 [%] or lower to 90 [%] or higher. For example, the powder packing density is changed to 97 [%].

Further, an electric current is fed through the powder 10 through the upper and lower punches 213 and 212. Because of the flowing electric current, the powder 10 is sintered or diffusion-bonded by heat generated between particles of the powder 10, heat generated from the inside of each particle, heat transmitted from the outside of particles through thermal conduction, and the like. Since the gap between particles of the powder 10 has a large electric resistance, Joule heat is generated by the flowing electric current. In this way, the sintered compact 217 can be formed in a shorter time than the time required in the powder metallurgy method. In the SPS method, the sintering temperature can be lowered as compared with that in an ordinary powder metallurgy method like the one shown in FIG. 1, so that in the case of an iron material, the temperature is, for example, 800 [° C.] or higher.

As described above, in the pressed current assisted sintering step, it is possible to form the sintered compact 217 from the powder 10 contained in the carbon mold 214 by feeding an electric current through the powder 10 while pressing the powder 10. In this process, the volume of the powder 10 contained in the carbon mold 214 rapidly changes while the powder 10 shrinks.

In the mold release discharging step, the sintered compact 217 is released from the carbon mold 214. Specifically, for example, the sintered compact 217, which has been formed by the pressed current assisted sintering step, is released from the carbon mold 214 by pushing the sintered compact 217 out of the carbon mold 214 by the lower punch 212. Then, the released sintered compact 217 is discharged (i.e., removed).

As shown in the Table 1, in the SPS method according to the comparative example 2, the sintering time can be shortened. For example, in the pressed current assisted sintering step, the time during which the powder 10 is at the sintering temperature is several seconds to several minutes, and is, for example, 1 [min]. However, in the SPS method, since a high pressure cannot be applied to the carbon mold 214, it is impossible to mold a sintered compact 217 having a complicated shape.

Further, the powder 10 contained in the carbon mold 214 rapidly shrinks during the sintering. Therefore, the displacement (i.e., the moving distance) of the punch in the pressed current assisted sintering step increases, thus raising a possibility of a failure such as a failure that a powder caught in the gap between the carbon mold and the punch is sintered.

Further, since the mold and the punch are rubbed against each other under the high temperature environment, the lifespan of the mold is short because of, for example, the seizing up of the mold and the punch. Further, since the mold is used under the high-temperature and abrasive environment, it is necessary to select a heat-resistant alloy having wear resistance as the material for the mold and the punch, so that the manufacturing cost of the mold is high. Under these circumstances, it is difficult to reduce production costs.

Embodiment: Current Assisted Sintering Method

Figure 3:
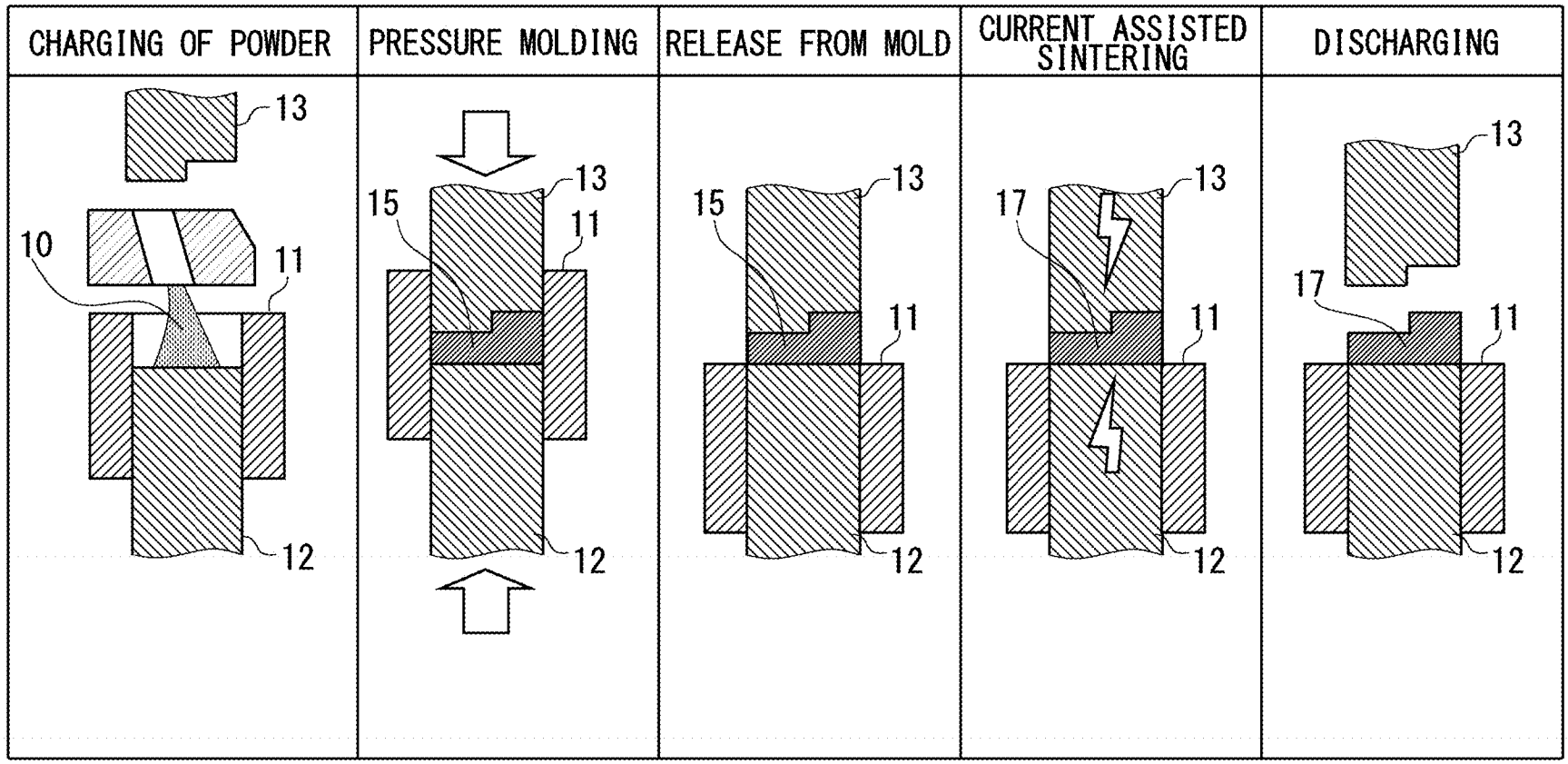
FIG. 3 is a flow sheet showing an example of a current assisted sintering method according to a first embodiment.
Figure 4:
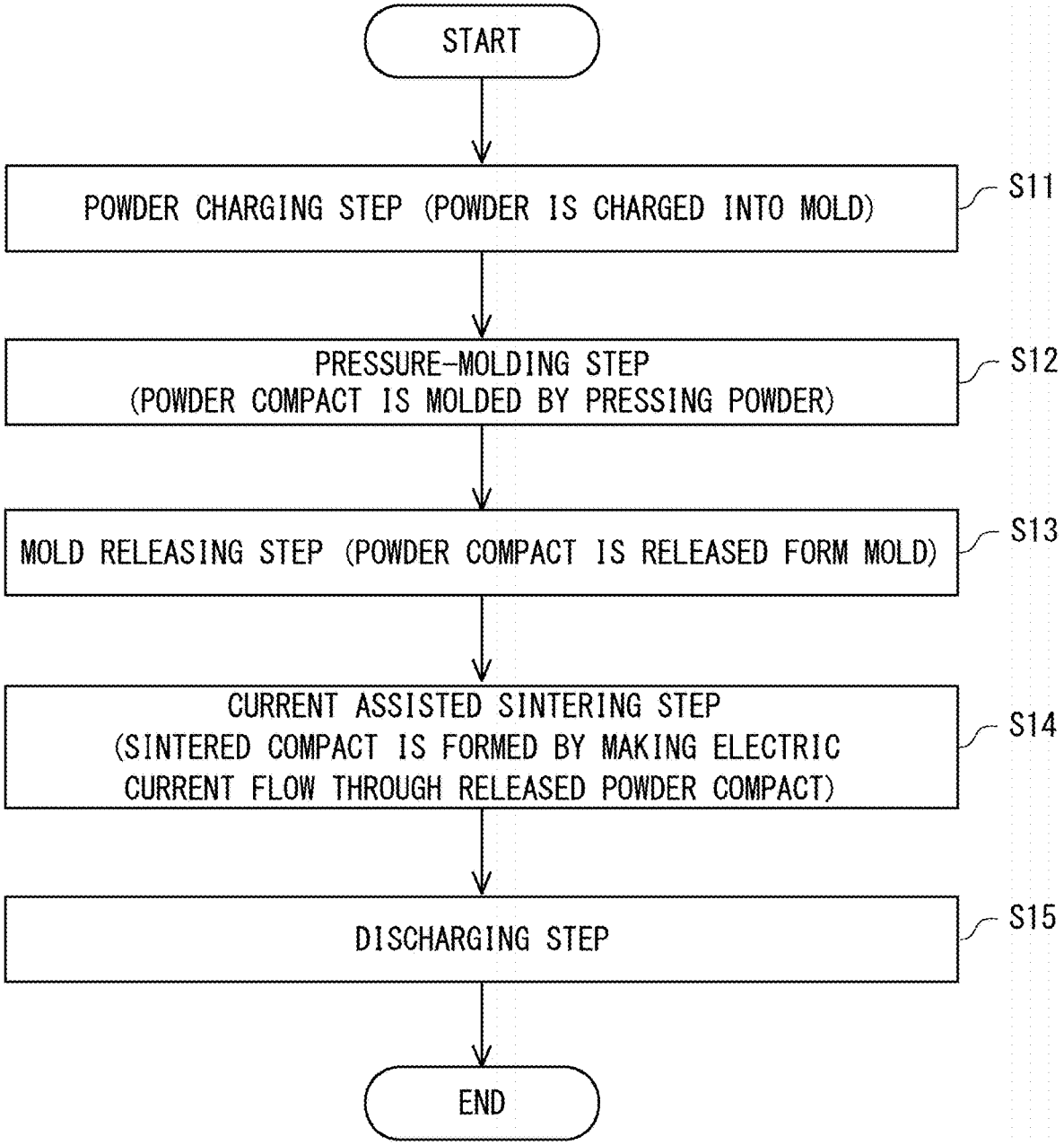
FIG. 4 is a flowchart showing the example of the current assisted sintering method according to the first embodiment.

Next, a current assisted sintering method according to an embodiment of the present disclosure will be described. In the current assisted sintering method according to this embodiment, a high-density powder compact is formed by, after a powder is charged into a mold, pressing the powder at a low temperature and at a high pressure. Then, a sintered compact is formed by releasing the formed powder compact from the mold and feeding an electric current through the released powder compact. FIG. 3 is a flow sheet showing an example of the current assisted sintering method according to the first embodiment. FIG. 4 is a flowchart showing an example of the current assisted sintering method according to the first embodiment. As shown in FIGS. 3 and 4, the current assisted sintering method according to the first embodiment includes a powder charging step, a pressure-molding step, a mold releasing step, a current assisted sintering step, and a discharging step. Note that the current assisted sintering method according to this embodiment may also include a powder mixing step prior to the powder charging step when the used powder 10 contains a plurality of types of materials.

As shown in a step S11 in FIGS. 3 and 4, in the powder charging step in this embodiment, a powder 10 is charged into a mold 11. The powder 10 may be similar to that used in the comparative example 1, but is preferably a conductive powder 10.

The mold 11 has, for example, a cylindrical shape in which its upper end and lower end are opened. In the case where the powder 10 charged in the mold 11 is pressed in the vertical direction, the mold 11 preferably has a cylindrical shape in which its upper end and lower end are opened. Note that in the case where the powder 10 charged in the mold 11 is pressed in a direction other than the vertical direction, the mold 11 may have a cylindrical shape in which its one end and the other end in the pressing direction are opened. For example, when the powder 10 is pressed in the horizontal direction, the mold 11 may have a cylindrical shape in which its end on the left side and the other end on the right side are opened.

A lower punch 12 is inserted into the lower opening of the mold 11. As a result, a cavity is formed over the lower punch 12 inside the mold 11. Then, the powder 10 is charged into the cavity surrounded by the mold 11. An upper punch 13 is inserted into the upper opening of the mold 11, which has been filled with the powder 10. In the powder charging step, the packing density of the powder 10 charged in the mold 11 is, for example, about 50 [%] as in the comparative examples 1 and 2. Note that each of the lower and upper punches 12 and 13 may be composed of a plurality of punch members as in the comparative example 1.

Next, as shown in a step S12 in FIG. 3 and FIG. 4, in the pressure-molding step, a powder compact 15 is molded by pressing the powder 10.

Specifically, the powder 10 charged in the mold 11 is pressed by the lower punch 12, which has been inserted into one of the openings of the mold 11, and the upper punch 13, which has been inserted into the other opening. In this way, the powder compact 15 is molded. The pressure, which is expressed by the gauge pressure, applied to the powder 10 is, for example, 100 to 700 [MPa], or 700 [MPa] or higher.

In the pressure-molding step, the temperature of the powder is lower than 500 [° C.]. Heat is preferably not intentionally applied, and the temperature is, for example, 300 [° C.] and, specifically, in a range from a room temperature to 400 [° C.]. In this way, the powder compact 15 in which the powder 10 is compressed is molded. In the pressure-molding step, the packing density of the powder 10 is changed, for example, from a density lower than 60 [%] to 60 [%] or higher. In the case of a porous body (or a porous compact) used for a hydraulic bearing (or an oil hydraulic) or the like, the packing density is changed to, for example, 75 [%]. In the case where a dense sintered compact is formed, the packing density is changed, for example, from a density lower than 90 [%] to 90 [%] or higher. Specifically, in the case of forming a dense sintered compact, the packing density of the powder 10 is improved from about 50 [%] to, for example, 95 [%]. In this way, the particles of the powder 10 are compacted. In the pressure-molding step, the powder 10 charged in the mold 11 may be processed in an atmospheric atmosphere, but is preferably processed in a reduced-pressure atmosphere such as in a vacuum, or in an inert-gas atmosphere. The pressure applied to the powder 10 by the vertical movements of the upper and lower punches 13 and 12 is expressed by the gauge pressure.

In the current assisted sintering method according to this embodiment, a mold 11 made of a material other than carbon may be used. For example, a mold 11 made of a material containing a metal may be used. Therefore, it is possible to apply a high pressure of about 700 [MPa]. Therefore, by using a mold 11 having a cavity surface having a complicated shape, it is possible to form a powder compact 15 having a complicated shape that accurately conforms to the shape of the cavity surface of the mold 11. Further, it is possible to repeatedly manufacture powder compacts 15 having identical shapes by using one mold 11. Therefore, it is possible to manufacture a large number of powder compacts 15 having identical shapes.

Next, as shown in a step S13 in FIGS. 3 and 4, in the mold releasing step, the powder compact 15 is released from the mold 11. For example, the powder compact 15 is released from the mold 11 by pushing the powder compact 15 out of the mold 11 by the lower punch 12.

Next, as shown in a step S14 in FIGS. 3 and 4, in the current assisted sintering step, an electric current is fed through the powder compact 15, which has been released from the mold 11, so that a sintered compact 17 is formed. For example, an electric current is fed through the powder compact 15 through the upper and lower punches 13 and 12. In the current assisted sintering step, because of the electric current flowing through the powder compact 15, each particle of the powder 10 in the powder compact 15 is sintered or diffusion-bonded by heat generated between each pair of particles of the powder, heat generated from the inside of each particle (from each particle itself), heat transmitted from the outside of particles through thermal conduction, and the like. For example, a dense compact is formed by the sintering, or a porous body (or a porous compact) is formed through diffusion-bonding.

In the current assisted sintering step, an electric current is fed through the powder compact 15 without pressing the powder compact 15 by the upper and lower punches 13 and 12. That is, in the current assisted sintering step, no pressure other than those which are unavoidable due to the contact of the upper and lower punches 13 and 12 or the contact of electrodes or the like, necessary for feeding an electric current is applied to the powder compact 15. That is, although the minimum pressure required for operating the apparatus (the lower limit of the load limiter) and the unavoidable pressure(s) are applied, no pressure other than these unavoidable pressures is applied. In the current assisted sintering step, the pressure applied to the powder compact 15 is 0 [MPa] except for such unavoidable pressures, and the powder compact 15 is not intentionally pressed. Note that the minimum pressure required for operating the apparatus (the lower limit of the load limiter) may be substantially unnecessary. However, in some cases, 100 [kgf] may be applied as the lower limit of the load limiter. The temperature of the powder compact 15 by the flowing electric current is adjusted to a temperature lower than the melting point of the material of the powder 10. For example, in the current assisted sintering step, the temperature of the powder compact 15 is 500 [° C.] or higher. In the case where an aluminum alloy is sintered, for example, the temperature is 600 [° C.] or higher. In the case of an alloy containing iron as a main component, the temperature of the powder compact 15 is preferably 800 [° C.] or higher. It is extremely difficult to form a sintered compact made of an aluminum alloy by using the powder metallurgy method according to the comparative example 1, but such a sintered compact can be formed by the SPS method according to the comparative example 2 or the method according to this embodiment. Further, in the current assisted sintering method according to this embodiment, unlike the SPS method according to the comparative example 2, the temperature during the pressure-molding and the temperature during the current assisted sintering differ from each other.

In the current assisted sintering step according to this embodiment, although the powder compact 15 is heated, for example, by feeding an electric current through the powder compact 15, the mold 11 does not need to be heated. Therefore, the method according to this embodiment also differs from the SPS method according to the comparative example 2 because the carbon mold 214 is heated together with the powder 10 in the SPS method. In this way, the sintered compact 17 is formed. In the current assisted sintering step, the packing density of the powder 10 is kept, for example, at 60 [%] or higher. In the case of a porous body, the packing density is kept, for example, at 60 [%] or higher. In the case of forming a dense sintered compact, the packing density is kept, for example, at 90 [%] or higher. For example, the powder packing density of the sintered compact 17 after the current assisted sintering step is 97 [%]. Further, in the current assisted sintering step, an electric current is fed through the powder compact 15 in a reduced-pressure atmosphere such as in a vacuum, or in an inert-gas atmosphere.

Next, as shown in a step S15 in FIGS. 3 and 4, in the discharging step, the formed sintered compact 17 is discharged (i.e., removed). In this manner, the sintered compact 17 can be formed.

As shown in the Table 1, in the current assisted sintering method according to this embodiment, it is possible to mold a powder compact 15 having a complicated shape, and thereby to form a sintered compact 17 having a complicated shape. Further, since the current assisted sintering is adopted, it is possible to form the sintered compact 17 in a short time. For example, in the current assisted sintering step, the time during which the powder compact 15 is kept at the sintering temperature is several seconds to several minutes, and is, for example, 1 [min].

Further, since the powder compact 15 is formed by compressing the powder in the pressure-molding step, the powder compact 15 do not rapidly shrink during the sintering in the current assisted sintering step. Therefore, in the current assisted sintering step, the displacement of the punch is almost zero except for the displacement caused by the thermal expansion of the material of the punch and the like, thus making it possible to prevent or reduce the deviations from the target size and the target shape of the sintered compact 17 and to suppress the formation of burrs therein. In this way, it is possible to reduce the defect rate, and to improve the dimensional accuracy and the geometric accuracy.

Further, it is possible to prevent the powder 10 from being baked on the mold 11, and thereby to increase the lifespan of the mold 11. Because of these features, it is possible to manufacture a large number of components using sintered compacts 17 having complicated shapes through the current assisted sintering, and thereby to reduce production costs.

<Current Assisted Sintering Apparatus>

Figure 5:
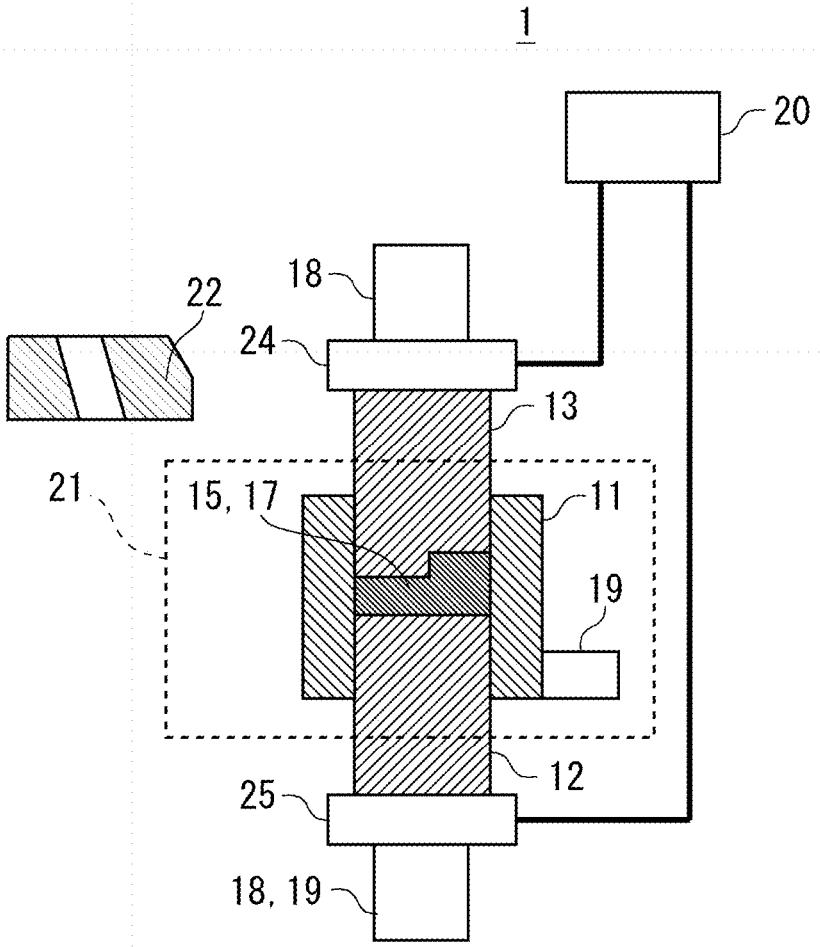
FIG. 5 is a configuration diagram showing an example of a current assisted sintering apparatus according to the first embodiment.
Figure 6:
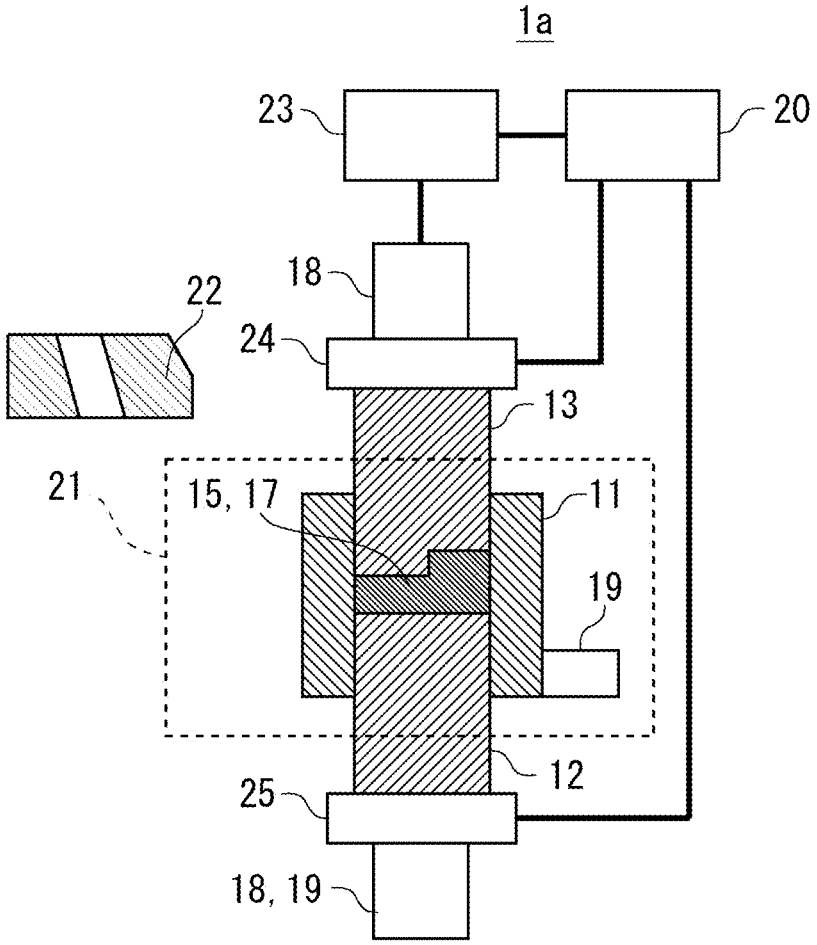
FIG. 6 is a configuration diagram showing an example of a current assisted sintering apparatus according to another example of the first embodiment.

Next, a current assisted sintering apparatus according to an embodiment of the present disclosure will be described. FIG. 5 is a configuration diagram showing an example of a current assisted sintering apparatus according to the first embodiment. FIG. 6 is a configuration diagram showing an example of a current assisted sintering apparatus according to another example of the first embodiment. As shown in FIGS. 5 and 6, each of current assisted sintering apparatuses 1 and 1*a* includes a mold 11, an upper punch 13, a lower punch 12, pressure-molding means 18, mold releasing means 19, and current assisted sintering means 20. Further, the current assisted sintering apparatus 1 may include a chamber 21 and powder charging means 22, and may include a pressure gauge, a thermometer, and an ammeter (not shown). Further, as shown in FIG. 6, the current assisted sintering apparatus 1*a* may include control means 23 for forming a sintered compact 17 in an automated manner.

The mold 11 has, for example, a cylindrical shape in which its one end and the other end are opened. The one opening and the other opening are, for example, a lower opening and an upper opening, respectively. The lower punch 12 is inserted into the one opening. The upper punch 13 is inserted into the other opening. The mold 11 is made of a material containing a metal. In the case where the current assisted sintering apparatus 1 includes the chamber 21, the mold 11 is disposed inside the chamber 21.

The inside of the chamber 21 can be in a reduced-pressure atmosphere such as in a vacuum, or in an inert-gas atmosphere. Therefore, the powder 10 charged in the mold 11 may be pressure-molded in a reduced-pressure atmosphere or an inert-gas atmosphere. Further, the powder compact 15 released from the mold may be electric-current-sintered in a reduced-pressure atmosphere or an inert-gas atmosphere. The reduced-pressure atmosphere or the inert-gas atmosphere inside the chamber 21 is controlled by a discharging valve, a discharging pump, an inert-gas supply valve, and the like provided in the chamber 21.

The chamber 21 may include, for example, an upper outer wall including an upper punch 13 and a lower outer wall including a lower punch 12 as disclosed in Patent Literature 1. In this way, the limited hermitically-sealed space including the mold 11 may be brought into a reduced-pressure atmosphere or an inert-gas atmosphere.

The powder charging means 22 charges the powder 10 into the mold 11. The powder charging means 22 is, for example, a powder supplying machine.

The pressure-molding means 18 forms a powder compact 15 by pressing the powder 10 charged in the mold 11. The pressure-molding means 18 is, for example, a motor for performing mechanical pressing. Note that the pressure-molding means 18 is not limited to the motor as long as it can mold the powder compact 15 by pressing the powder 10 charged in the mold 11. For example, the pressure-molding means 18 may be a pump for performing hydraulic pressing. The pressure-molding means 18 pressurizes the powder 10 by the lower punch 12 inserted into the one opening of the mold and the upper punch 13 inserted into the other opening thereof. The pressure-molding means 18 adjusts the pressure applied to the powder 10 to 100 to 700 [MPa], or 700 [MPa] or higher in a state in which the temperature of the powder is lower than 500 [° C.]. By doing so, the pressure-molding means 18 changes the packing density of the powder 10 from, for example, a density lower than 60 [%] to 60 [%] or higher.

The mold releasing means 19 releases the powder compact 15 from the mold 11. The mold releasing means 19 is, for example, a motor of the lower punch 12. The mold releasing means 19 releases the powder compact 15 from the mold 11 by pushing the powder compact 15 out of the mold 11 by the lower punch 12. In this case, the mold 11 may be fixed. Note that the mold releasing means 19 is not limited to the motor of the lower punch 12 as long as it can release the powder compact 15 from the mold 11. For example, the mold releasing means 19 may be a pump or the like of the lower punch 12, or may be a motor or a pump for moving the mold 11, provided in the mold 11.

Figure 7:
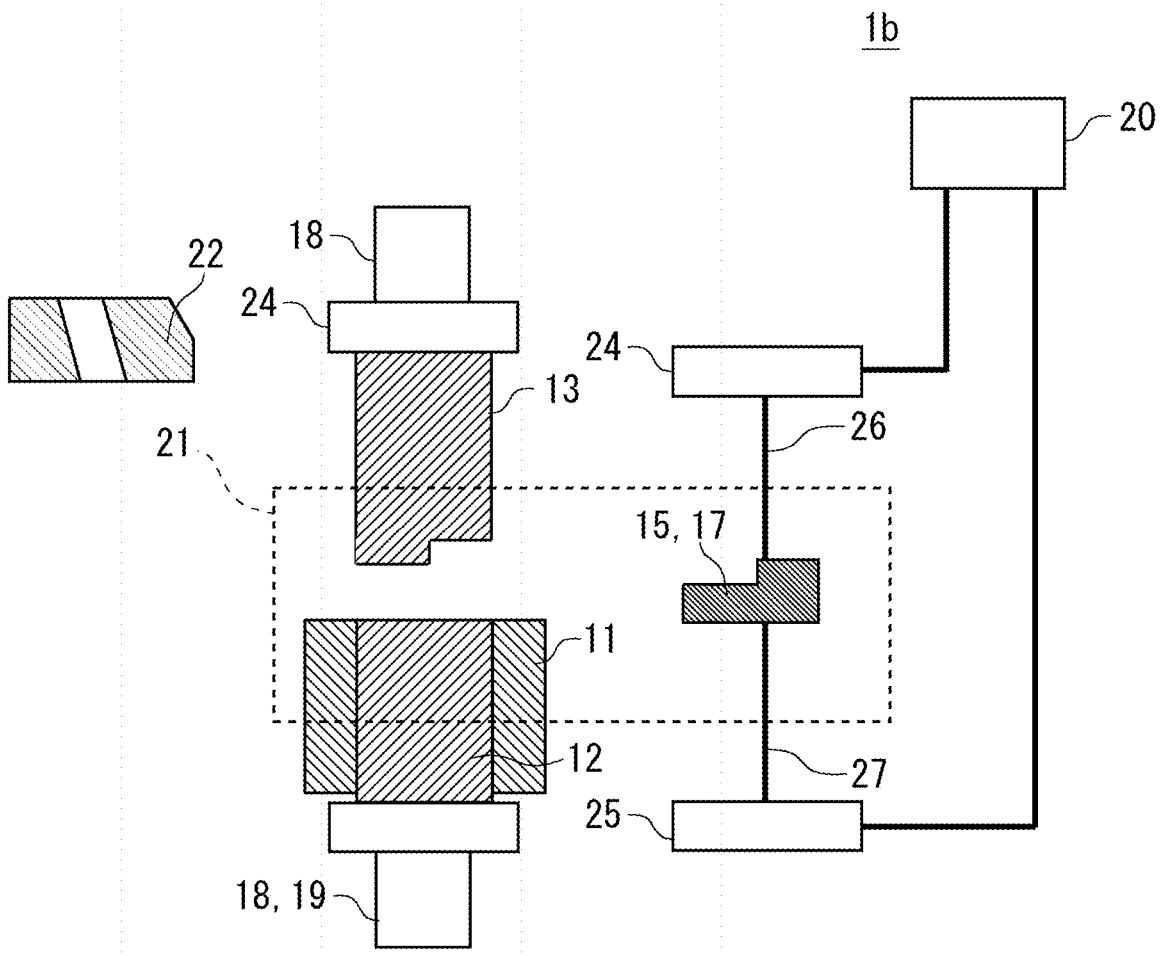
FIG. 7 is a configuration diagram showing an example of a current assisted sintering apparatus according to yet another example of the first embodiment.

FIG. 7 is a configuration diagram showing an example of a current assisted sintering apparatus according to yet another example of the first embodiment. As shown in FIG. 7, in a current assisted sintering apparatus 1*b*, the mold releasing means 19 may detach the powder compact 15 from the mold 11, and from the lower and upper punches 12 and 13, and thereby release the powder compact 15 from the mold 11. Note that although not shown in the drawings, the current assisted sintering apparatus 1*b* may also include control means 23 for forming a sintered compact 17 in an automated manner.

As shown in FIGS. 5 to 7, the current assisted sintering means 20 forms a sintered compact 17 by feeding an electric current through the powder compact 15 released from the mold 11. The current assisted sintering means 20 is, for example, a power supply. Note that the current assisted sintering means 20 is not limited to the power supply and may be a cell(s) or a battery(ies) as long as it can form a sintered compact 17 by feeding an electric current through the powder compact 15 released from the mold 11.

As shown in FIGS. 5 and 6, the current assisted sintering means 20 may feed an electric current through the powder compact 15 through the upper and lower punches 13 and 12. Specifically, the current flow path along which an electric current flows extends from the current assisted sintering means 20, passes through an electrode 24, the upper punch 13, the powder compact 15, the lower punch 12, and an electrode 25, and returns to the current assisted sintering means 20. The electrode 24 is disposed above the upper punch 13 and connected to the current assisted sintering means 20. The electrode 25 is disposed below the lower punch 12 and connected to the current assisted sintering means 20. The upper and lower punches 13 and 12 have functions as terminals through which an electric current is fed to the powder compact 15.

Further, as shown in FIG. 7, in the case where the powder compact 15 is removed from the mold 11, and from the lower and upper punches 12 and 13, the current assisted sintering means 20 may feed an electric current through the powder compact 15 through terminals 26 and 27 without making the electric current pass through the upper and lower punches 13 and 12. The terminal 26 is disposed between the electrode 24 and the powder compact 15. The terminal 27 is disposed between the electrode 25 and the powder compact 15. The current flow path along which an electric current flows extends from the current assisted sintering means 20, passes through the electrode 24, the terminal 26, the powder compact 15, the terminal 27, and the electrode 25, and returns to the current assisted sintering means 20. Note that the current flow path may extend from the current assisted sintering means 20, pass through the terminal 26, the powder compact 15, and the terminal 27 without passing through the electrodes 24 and 25, and returns to the current assisted sintering means 20.

The current assisted sintering means 20 may adjust the temperature of the powder to 500 [° C.] or higher in a state in which the pressure applied to the powder, i.e., the pressure other than the unavoidable pressures, is 0 [MPa]. The current assisted sintering means 20 keeps the packing density of the powder 10, for example, at 60 [%] or higher. In the case of a porous body, the current assisted sintering means 20 keeps the packing density, for example, at 60 [%] or higher. In the case of forming a dense sintered compact, the current assisted sintering means 20 keeps the packing density, for example, at 90 [%] or higher. The current assisted sintering means 20 sinters or diffusion-bonds each particle of the powder 10 in the powder compact 15 by heat generated between each pair of particles, heat generated from the inside of each particle, heat transmitted from the outside of particles through thermal conduction, and the like.

As shown in FIG. 5, the operations of the pressure-molding means 18, the mold releasing means 19, the current assisted sintering means 20, the chamber 21, and the powder charging means 22 in the current assisted sintering apparatus 1 may be manually controlled. Alternatively, as shown in FIG. 6, the current assisted sintering apparatus 1*a* may include control means 23 for controlling the operations of the pressure-molding means 18, the mold releasing means 19, the current assisted sintering means 20, the chamber 21, and the powder charging means 22 in order to form a sintered compact 17 in an automated manner.

The control means 23 is connected to the pressure-molding means 18, the mold releasing means 19, the current assisted sintering means 20, the chamber 21, and the powder charging means 22 through a cable(s), or through radio signal line(s) or the like. The control means 23 may be connected to a pressure gauge, a thermometer, and an ammeter by a signal line(s) or the like. The control means 23 is, for example, an information processing apparatus such as a personal computer or a server.

The control means 23 performs control so as to charge a predetermined supply amount of a powder 10 into the mold 11 by transmitting a signal to the powder charging means 22. Further, the control means 23 performs control so as to pressing the powder 10 charged in the mold 11 at a predetermined pressure by transmitting a signal to the pressure-molding means 18. The control means 23 performs control so as to release the powder compact 15 from the mold 11 by transmitting a signal to the mold releasing means 19. Further, the control means 23 performs control so as to feed an electric current through the powder compact 15 released from the mold 11 and thereby forms a sintered compact 17 by transmitting a signal to the current assisted sintering means 20.

The control means 23 may perform control so as to bring the inside of the chamber 21 into a predetermined reduced-pressure atmosphere or a predetermined inert-gas atmosphere by transmitting a signal to the chamber 21. The control means 23 may perform control so as to discharge (i.e., remove) the formed sintered compact 17.

The control means 23 may include a storage device such as a memory, and may store a program(s) for controlling the operations of the pressure-molding means 18, the mold releasing means 19, the current assisted sintering means 20, the chamber 21, and the powder charging means 22 in the storage device. Then, the control means 23 may control the operations of the pressure-molding means 18, the mold releasing means 19, the current assisted sintering means 20, the chamber 21, and the powder charging means 22 based on the program(s).

Figure 8:
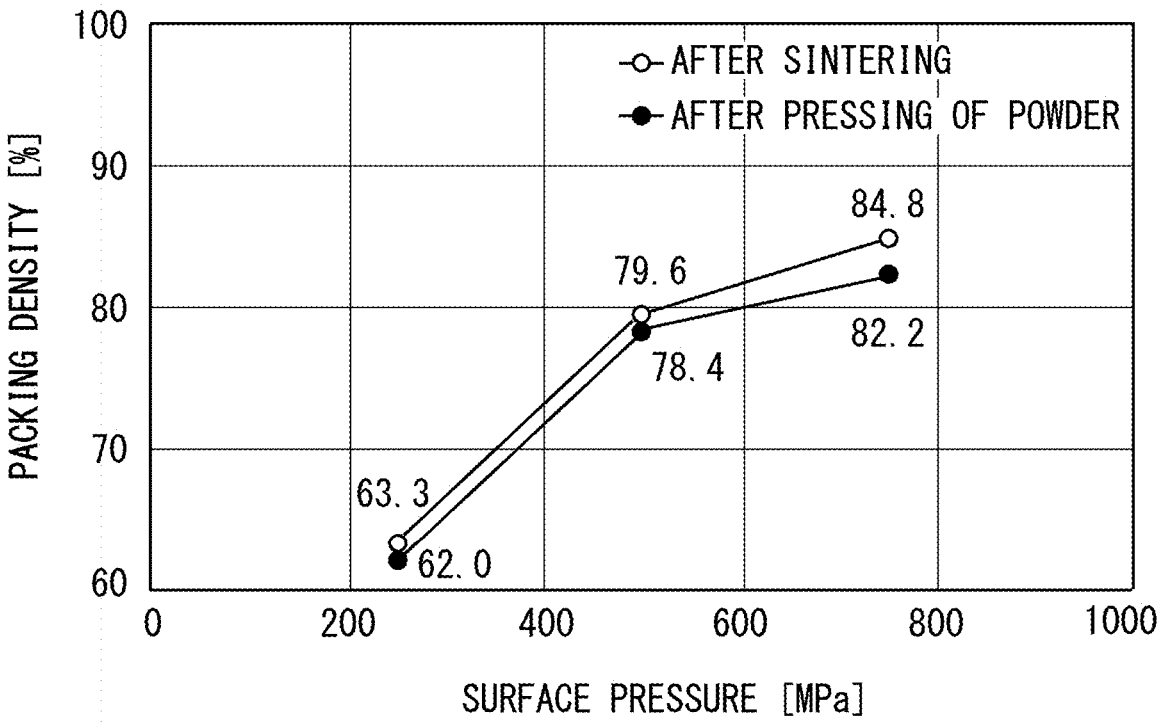
FIG. 8 is a graph showing an example of a relationship between surface pressures of a punch and packing densities of a sintered compact in a pressure-molding step in the current assisted sintering method using the current assisted sintering apparatus according to the first embodiment, in which a horizontal axis indicates the surface pressure and a vertical axis indicates the packing density.
Figure 9:
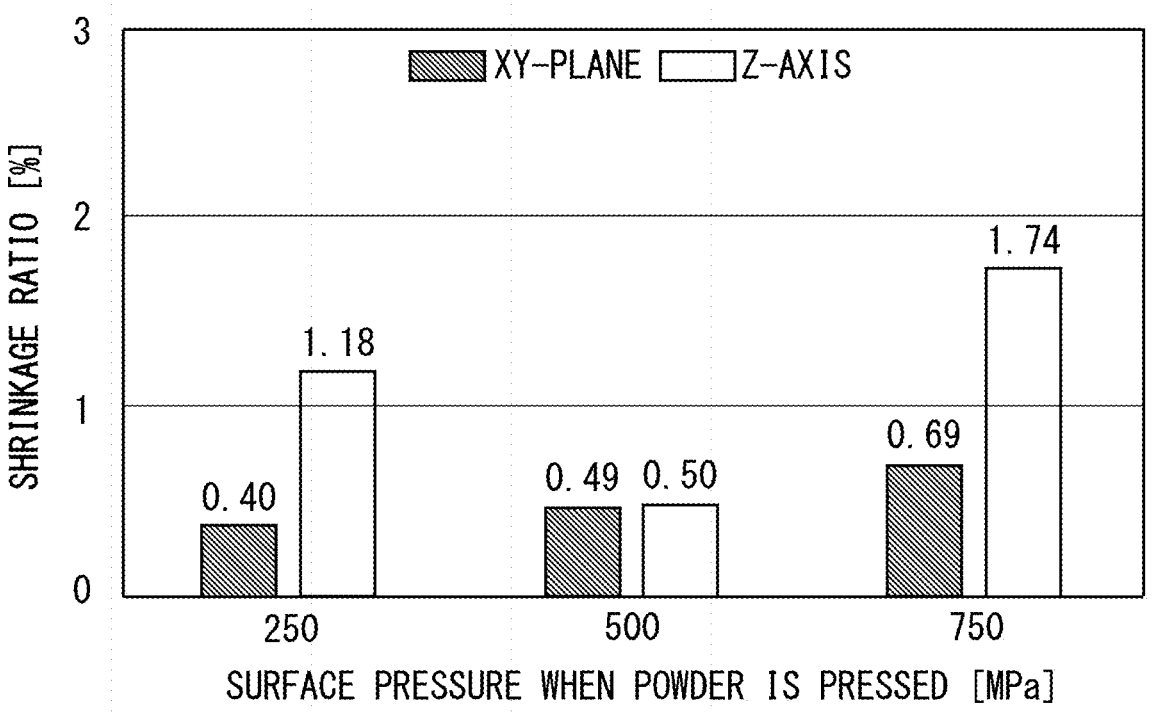
FIG. 9 is a graph showing an example of a relationship between surface pressures of a punch and shrinkage ratios of a sintered compact in a pressure-molding step in the current assisted sintering method using the current assisted sintering apparatus according to the first embodiment, in which a horizontal axis indicates the surface pressure and a vertical axis indicates the shrinkage ratio.
Figure 10:
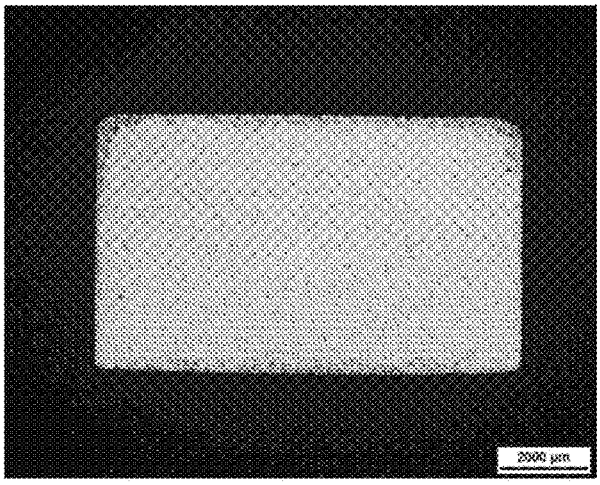
FIG. 10 is a cross-sectional view showing an example of a sintered compact in the current assisted sintering method using the current assisted sintering apparatus according to the first embodiment.
Figure 11:
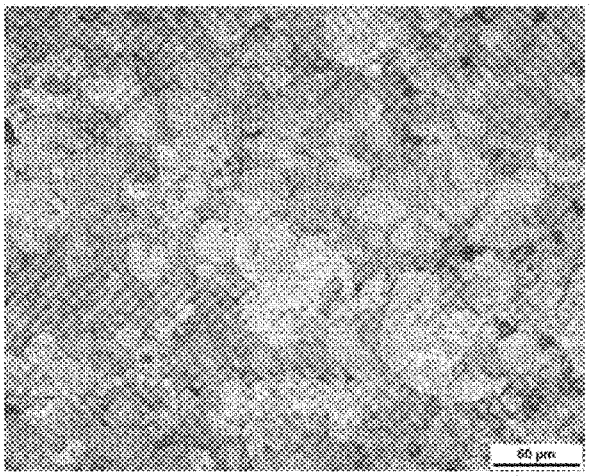
FIG. 11 is a cross-sectional view showing an example of a microstructure of a sintered compact in the current assisted sintering method using the current assisted sintering apparatus according to the first embodiment.

Next, as an example according to the present disclosure, an example in which a sintered compact 17 is formed by using the current assisted sintering apparatus 1*b* shown in FIG. 7 will be described. FIG. 8 is a graph showing an example of a relationship between surface pressures of a punch and packing densities of a sintered compact in the pressure-molding step in the current assisted sintering method using the current assisted sintering apparatus 1*b* according to the first embodiment, in which a horizontal axis indicates the surface pressure [MPa] and a vertical axis indicates the packing density [%]. In FIG. 8, black circles (•) indicate the relationship after the powder is compacted (after the pressure molding), and white circles (○) indicate the relationship after the sintering. FIG. 9 is a graph showing an example of a relationship between surface pressures of a punch and shrinkage ratios of a sintered compact in the pressure-molding step in the current assisted sintering method using the current assisted sintering apparatus 1*b* according to the first embodiment, in which a horizontal axis indicates the surface pressure [MPa] and a vertical axis indicates the shrinkage ratio [%]. In FIG. 9, hatched bars indicate shrinkage ratios in an XY-plane orthogonal to the pressing direction, and outlined bars (i.e., white bars) indicate shrinkage ratios in the Z-axis direction in which the pressure is applied. FIG. 10 is a cross-sectional view showing an example of a sintered compact in the current assisted sintering method using the current assisted sintering apparatus 1*b* according to the first embodiment. FIG. 11 is a cross-sectional view showing an example of a microstructure of a sintered compact in the current assisted sintering method using the current assisted sintering apparatus 1*b* according to the first embodiment.

As shown in FIG. 8, in the pressure-molding step, the packing densities of powder compacts 15 which were formed by pressing powders at surface pressures of 250, 500 and 750 [MPa] were 62.0, 78.4 and 82.2 [%], respectively. The packing densities of sintered compacts 17 formed by sintering the powder compacts 15, which were molded described above, were 63.3, 79.6 and 84.8 [%], respectively. As described above, in the current assisted sintering method according to this embodiment, the packing density of the powder 10 is changed from a density lower than 60 [%] to 60 [%] or higher in the pressure-molding step, and the packing density of the powder 10 is kept at 60 [%] or higher in the current assisted sintering step.

As shown in FIG. 9, in the pressure-molding step, the shrinkage ratios of a powder compact 15, which was formed by pressing the powder at a surface pressure of 250 [MPa], in the XY-plane and in the Z-axis are 0.40 and 1.18 [%], respectively. In the pressure-molding step, the shrinkage ratios of a powder compact 15, which was formed by pressing the powder at a surface pressure of 500 [MPa], in the XY-plane and in the Z-axis are 0.49 and 0.50 [%], respectively. In the pressure-molding step, the shrinkage ratios of a powder compact 15, which was formed by pressing the powder at a surface pressure of 750 [MPa], in the XY-plane and in the Z-axis are 0.69 and 1.74 [%], respectively. As described above, in the current assisted sintering method according to this embodiment, the shrinkage ratio in the Z-axis is generally larger than that in the XY-plane, though the difference is small in the case of 500 [MPa]. In this way, as shown in FIGS. 10 and 11, high-quality sintered compacts 17 can be formed.

Next, effects of the current assisted sintering apparatus 1 according to this embodiment will be described. Each of the current assisted sintering apparatuses 1, 1*a* and 1*b* can form a sintered compact 17 by the current assisted sintering method which provides the effects shown in the Table 1. Therefore, each of the current assisted sintering apparatuses 1, 1*a* and 1*b* can reduce the production cost of sintered compacts 17.

Further, the current assisted sintering means 20 can feed an electric current through a powder compact 15 through the upper and lower punches 13 and 12. In this way, it is possible to shorten the time required for the transition from the pressure molding to the current assisted sintering. Alternatively, the current assisted sintering means 20 can feed an electric current through the powder compact 15 through the terminals 26 and 27. In this way, it is possible to reduce the loss of the electric current which would otherwise be caused as the electric current flows through the upper and lower punches 13 and 12, and thereby to improve the lifespan of the upper and lower punches 13 and 12.

Since the current assisted sintering means 20 according to this embodiment sinters, through the current assisted sintering, each particle of the powder 10 by heat generated between each pair of particles of the powder 10, heat generated from the inside of each particle (from each particle itself), heat transmitted from the outside of particles through thermal conduction, and the like, the current assisted sintering means 20 can densify the sintered compact 17 while keeping the packing density of the powder 10 at 60 [%] or higher. Further, since the particles are diffusion-bonded, it is possible to form a porous body while keeping the packing density of the powder at 60 [%] or higher. Further, unlike the SPS method according to the comparative example 2, the pressure applied to the powder compact 15, i.e., the pressure other than the unavoidable pressures, is 0 [MPa], so that it is possible to prevent or reduce the displacement of the punch and to suppress the formation of burrs in the sintered compact 17. Further, it is possible to improve the lifespan of the mold 11 and those of the upper and lower punches 13 and 12.

By controlling the pressure-molding means 18, the mold releasing means 19, the current assisted sintering means 20, and the like by the control means 23, it is possible to automate the forming of sintered compacts 17 through current assisted sintering. Therefore, production costs can be reduced.

Second Embodiment

Next, a current assisted sintering apparatus 2 according to a second embodiment will be described. In the current assisted sintering apparatus according to this embodiment, a part in which pressure molding is performed is separated from a part in which current assisted sintering is performed. In this way, the pressure molding and the current assisted sintering can be performed in parallel with each other.

Figure 12:
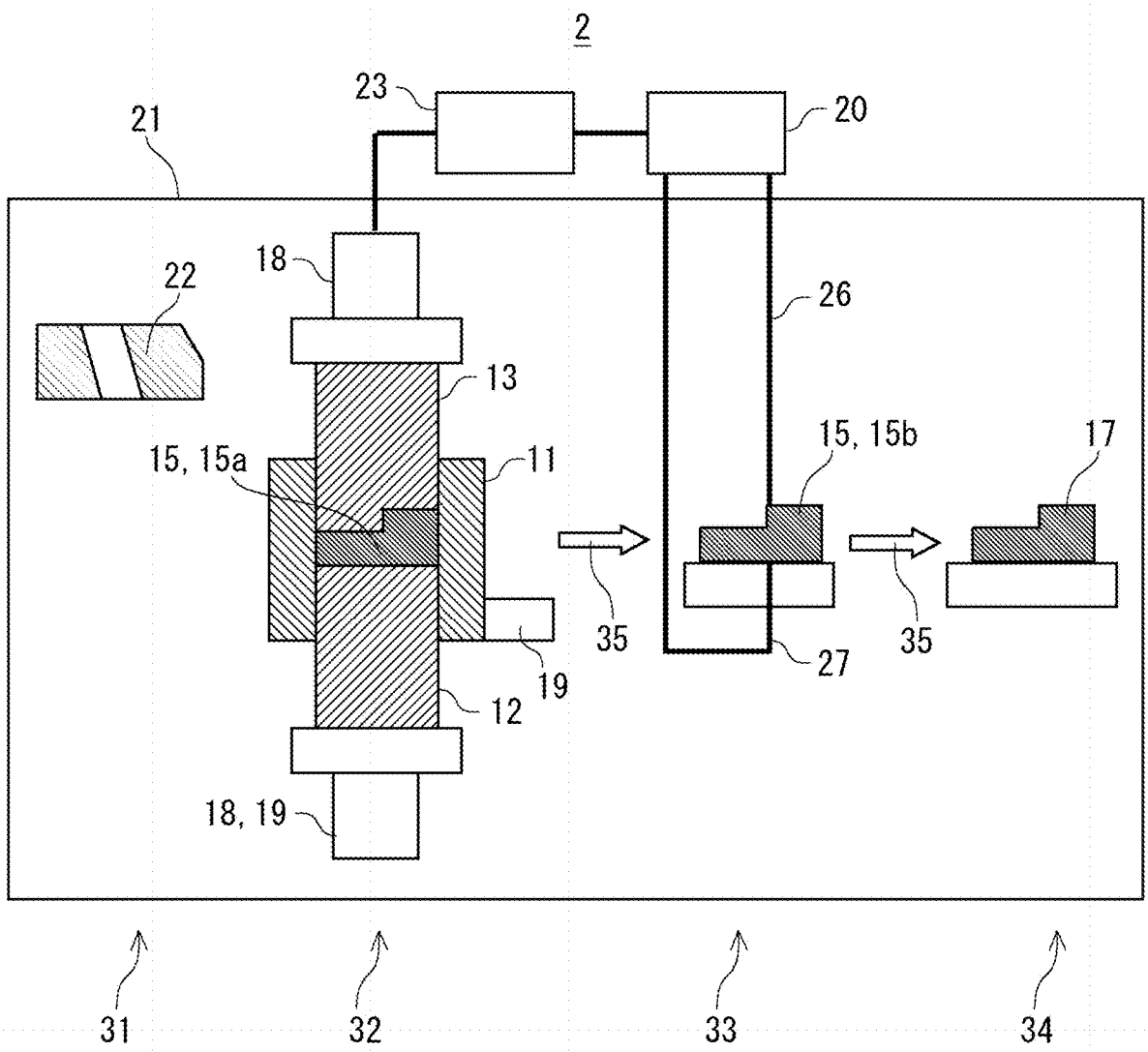
FIG. 12 is a configuration diagram showing an example of a current assisted sintering apparatus according to a second embodiment.

FIG. 12 is a configuration diagram showing an example of a current assisted sintering apparatus according to the second embodiment. As shown in FIG. 12, the current assisted sintering apparatus 2 includes a powder charging unit 31, a pressure-molding unit 32, a current assisted sintering unit 33, a discharging unit 34, and conveyance means 35. The current assisted sintering unit 33 is disposed side by side with the pressure-molding unit 32. The powder charging unit 31 may be disposed side by side with the pressure-molding unit 32, or may be integrated with the pressure-molding unit 32. The discharging unit 34 may be disposed side by side with the current assisted sintering unit 33, or may be integrated with the current assisted sintering unit 33.

Further, the current assisted sintering apparatus 2 may include a chamber 21. A mold 11, a lower punch 12, and an upper punch 13 may be disposed inside the chamber 21.

The powder charging unit 31 includes powder charging means 22. In the powder charging unit 31, the powder charging means 22 charges a powder 10 into the mold 11.

The pressure-molding unit 32 includes pressure-molding means 18 and mold releasing means 19. In the pressure-molding unit 32, the pressure-molding means 18 forms a powder compact 15 by pressing the powder 10 charged in the mold 11 by using the upper and lower punches 13 and 12. Further, in the pressure-molding unit 32, the mold releasing means 19 releases the powder compact 15 from the mold 11.

The conveyance means 35 conveys the powder compact 15 from the pressure-molding unit 32 to the current assisted sintering unit 33. The conveyance means 35 may be, for example, a conveyance stage for conveying the powder compact 15, or an arm for conveying the powder compact 15. The conveyance means 35 may convey the sintered compact 17 from the current assisted sintering unit 33 to the discharging unit 34.

The current assisted sintering unit 33 includes current assisted sintering means 20. In the current assisted sintering unit 33, the current assisted sintering means 20 forms a sintered compact 17 by feeding an electric current through powder compact 15 released from the mold 11. The discharging unit 34 discharges (i.e., removes) the formed sintered compact 17 from the current assisted sintering apparatus 2. The current assisted sintering apparatus 2 may further include control means 23 for controlling the pressure-molding means 18, the mold releasing means 19, the current assisted sintering means 20, and the conveyance means 35. In this way, the forming of sintered compacts 17 can be automated.

Figure 13:
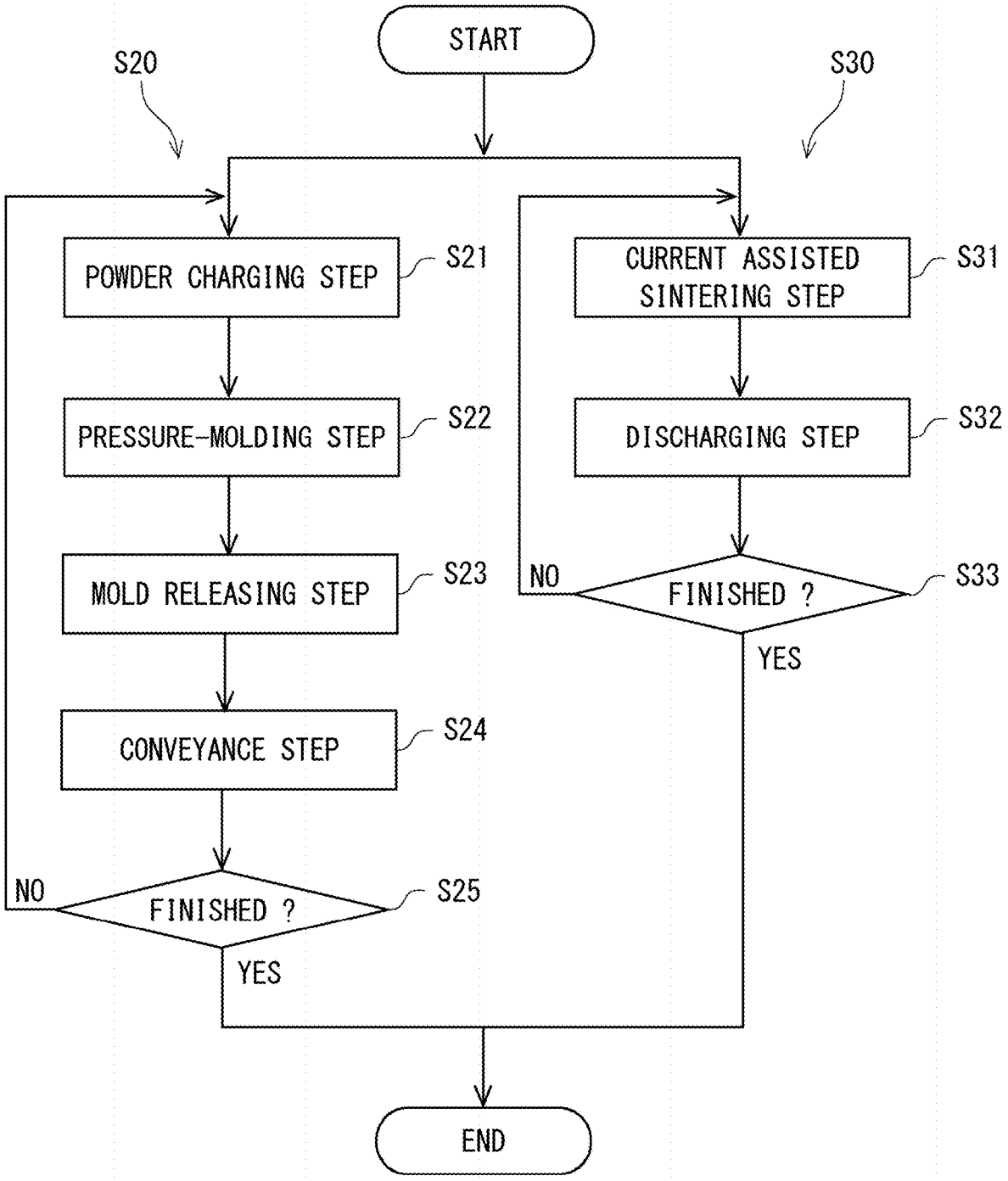
FIG. 13 is a flowchart showing an example of operations performed by the current assisted sintering apparatus according to the second embodiment.

Next, operations performed by the current assisted sintering apparatus 2 according to this embodiment will be described. FIG. 13 is a flowchart showing operations performed by the current assisted sintering apparatus according to the second embodiment. As shown in FIG. 13, the current assisted sintering apparatus 2 can perform a powder compact molding step S20 and a sintered compact forming step S30 in parallel with each other. The powder compact molding step S20 includes a powder charging step S21, a pressure-molding step S22, a mold releasing step S23, and a conveyance step S24. The sintered compact forming step S30 includes a current assisted sintering step S31 and a discharging step S32.

The powder compact molding step S20 will be described. In the powder charging step S21 shown in FIG. 13, the powder charging means 22 charges a powder 10 into the mold 11. The mold 11 is made of a material containing a metal, and has a cylindrical shape in which its one end and the other end are opened.

Next, in the pressure-molding step S22, the pressure-molding means 18 molds a powder compact 15 by pressing the powder 10 charged in the mold 11. For example, the pressure-molding means 18 presses the powder 10 by the upper and lower punches 13 and 12.

Next, in the mold releasing step S23, the mold releasing means 19 releases the powder compact 15 from the mold 11. For example, the mold releasing means 19 detaches the powder compact 15 from the mold 11, and from the upper and lower punches 13 and 12, and thereby releases the powder compact 15 from the mold 11.

Next, in the conveyance step S24, the conveyance means 35 conveys the powder compact 15 from the pressure-molding unit 32 to the current assisted sintering unit 33.

Next, in a step S25, it is determined whether or not the process in the powder compact molding step S20 should be finished. When the powder compact molding step S20 should be continued further, the process returns to the step S21, and the powder charging step S21 to the conveyance step S24 are continued. On the other hand, when the process of the powder compact molding step S20 should be finished in the step S25, the process is finished.

Next, the sintered compact forming step S30 will be described. In the current assisted sintering step S31 shown in FIG. 13, the current assisted sintering means 20 forms a sintered compact 17 by feeding an electric current through the powder compact 15 conveyed from the pressure-molding unit 32. For example, the current assisted sintering means 20 feeds an electric current to the conveyed powder compact 15 through the terminals 26 and 27.

Next, in the discharging step S32, the formed sintered compact 17 is discharged (i.e., removed). Next, in a step S33, it is determined whether or not the process of the sintered compact forming step S30 should be finished. When the sintered compact forming step S30 should be continued further, the process returns to the step S31, and the current assisted sintering step S31 to the discharging step S32 are continued. On the other hand, when the process of the sintered compact forming step S30 should be finished in the step S33, the process is finished. In this manner, the sintered compact 17 can be formed. In the current assisted sintering method according to this embodiment, when a powder compact 15*a* is molded in the pressure-molding step S22, in parallel therewith, an electric current is fed through a powder compact 15*b* different from the powder compact 15*a* so that a sintered compact 17 can be formed therefrom in the current assisted sintering step S31. Specifically, when the pressure-molding means 18 molds the powder compact 15*a*, in parallel therewith, the current assisted sintering means 20 can form a sintered compact 17 by feeding an electric current through the powder compact 15*b*.

Next, effects of this embodiment will be described. In the current assisted sintering apparatus 2 according to this embodiment, the pressure-molding unit 32 that performs pressure molding is separated from the current assisted sintering unit 33 that performs current assisted sintering.

In this way, the molding of a powder compact 15 through the pressure molding and the forming of a sintered compact 17 through the current assisted sintering can be performed in parallel with each other. Therefore, the production time can be shortened.

Further, since the mold 11, and the upper and lower punches 13 and 12 used for the pressure molding can be separated from the terminals 26 and 27 used for the current assisted sintering, the lifespan of each component can be improved.

Figure 14:
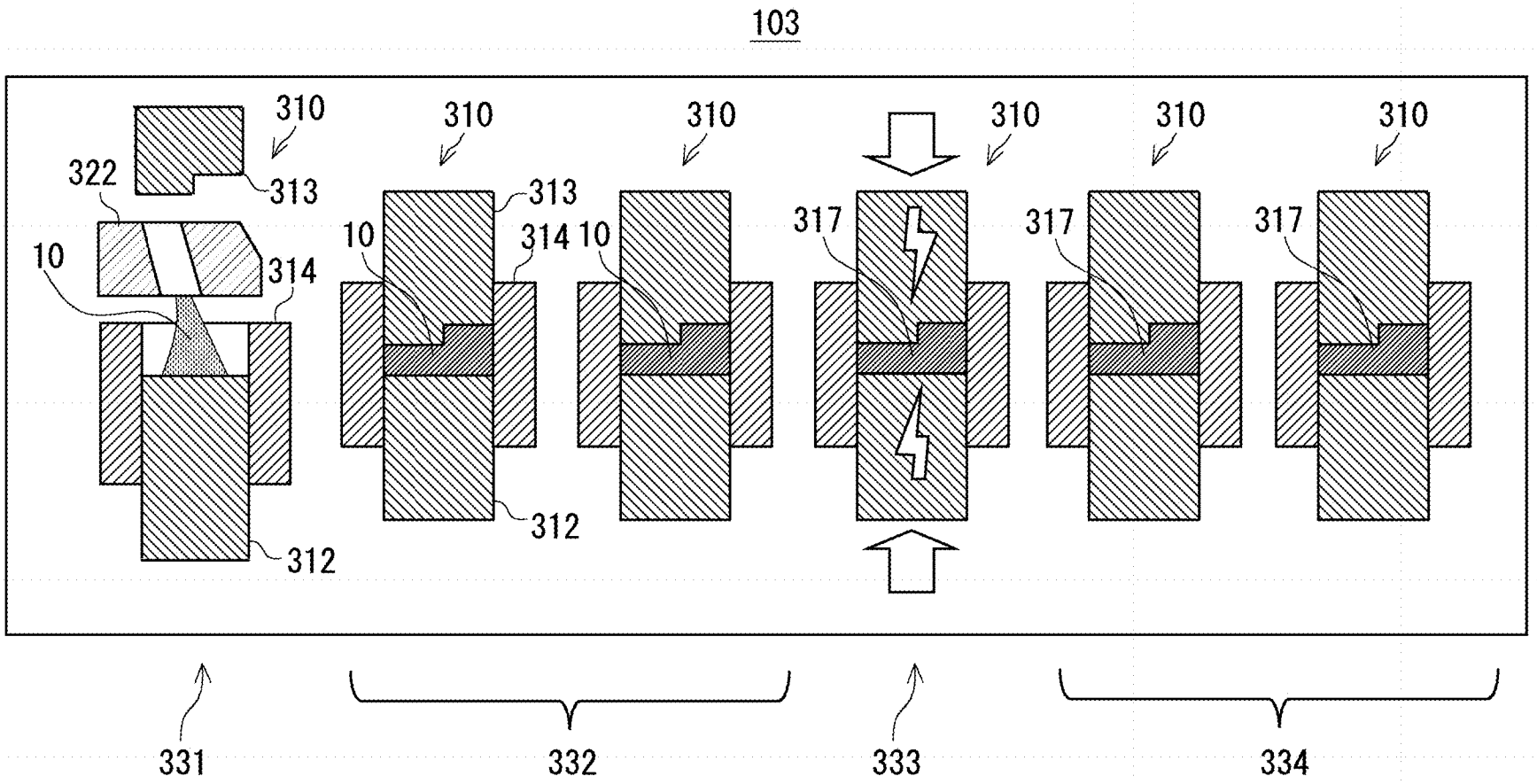
FIG. 14 is a configuration diagram showing an example of an SPS apparatus according to a comparative example 3.

FIG. 14 is a configuration diagram showing an example of an SPS apparatus according to a comparative example 3. As shown in FIG. 14, an SPS apparatus 103 includes a powder charging unit 331, a preheating unit 332, a current assisted sintering unit 333, and a cooling unit 334. Further, the SPS apparatus 103 includes a plurality of mold sets 310 and powder charging means 322. Each mold set 310 includes a carbon mold (i.e., a mold made of carbon) 314, an upper punch 313, and a lower punch 312. The plurality of mold sets 310 are successively conveyed from the powder charging unit 331 to the cooling unit 334, and are subjected to a powder charging process, a preheating process, a current assisted sintering process, and a cooling process at the powder charging unit 331, the preheating unit 332, the current assisted sintering unit 333, and the cooling unit 334, respectively. At each of the powder charging unit 331, the preheating unit 332, the current assisted sintering unit 333, and the cooling unit 334, a process is performed for at least one mold set 310 at all times.

In the SPS apparatus 103 according to the comparative example 3, the powder charging process, the preheating process, the current assisted sintering process, and the cooling process can be successively performed, so that the production time of sintered compacts 317 can be shortened to some extent. However, in the SPS apparatus 103 according to the comparative example 3, since a large number of expensive carbon dies 314 need to be prepared, production costs increase.

In contrast, the current assisted sintering apparatus 2 according to this embodiment does not require an expensive carbon mold 314. Further, a plurality of powder compacts 15 can be molded by using one mold 11. Therefore, production costs can be reduced. Further, since the powder compact 15 is released from the mold 11 when the current assisted sintering is performed, it is possible to improve the lifespan of the mold 11 and to reduce production costs even further. Other effects are the same as those described in the description of the first embodiment.

The present invention made by the inventors of the present application has been described above in a concrete manner based on embodiments. However, the present invention is not limited to the above-described embodiments, and needless to say, various modifications can be made without departing from the spirit and scope of the invention.

This application is based upon and claims the benefit of priority from Japanese patent application No. 2020-105151, filed on Jun. 18, 2020, the disclosure of which is incorporated herein in its entirety by reference.

REFERENCE SIGNS LIST

1, 1*a*, 1*b*, 2 CURRENT ASSISTED SINTERING APPARATUS
10 POWDER
11 MOLD
12 LOWER PUNCH
13 UPPER PUNCH
15, 15*a*, 15*b* POWDER COMPACT
17 SINTERED COMPACT
18 PRESSURE MOLDING MEANS
19 MOLD RELEASING MEANS
20 CURRENT ASSISTED SINTERING MEANS
21 CHAMBER
22 POWDER CHARGING MEANS
23 CONTROL MEANS
24, 25 ELECTRODE
26, 27 TERMINAL
31 POWDER CHARGING UNIT
32 PRESSURE MOLDING UNIT
33 CURRENT ASSISTED SINTERING UNIT
34 DISCHARGING UNIT
35 CONVEYANCE MEANS
103 SPS APPARATUS
111 MOLD
112 LOWER PUNCH
113 UPPER PUNCH
115 POWDER COMPACT
116 SINTERING FURNACE
117 SINTERED COMPACT

212 LOWER PUNCH
213 UPPER PUNCH
214 CARBON MOLD
217 SINTERED COMPACT
310 MOLD SET
322 POWDER CHARGING MEANS
331 POWDER CHARGING UNIT
332 PREHEATING UNIT
333 CURRENT ASSISTED SINTERING UNIT
334 COOLING UNIT

The invention claimed is:

1. A current assisted sintering method comprising the steps of:

(A) molding a powder compact by pressing a powder charged in a mold;

(B) releasing the powder compact from the mold; and (C) forming a sintered compact by feeding an electric current through the powder compact released from the mold, wherein in the (A) step, a temperature of the powder is lower than 500° C., and a pressure applied to the powder is 100 to 700 MPa, in the (C) step, a temperature of the powder compact is 500° C. or higher, and a pressure applied to the powder compact, except for an unavoidable pressure, is 0 MPa, wherein the steps (A) to (C) are performed in a reduced-pressure atmosphere or in an inert-gas atmosphere of an inside of a chamber, wherein in the (A) step, a cylindrical mold, of which one end and the other end are opened, made of a material containing a metal is used as the mold, and the powder is pressed by a first punch inserted into the one opening and a second punch inserted into the other opening, in the (B) step, the powder compact is released from the mold by pushing the powder compact out of the mold by the first punch, and in the (C) step, an electric current is fed through the powder compact through the first and second punches.

2. The current assisted sintering method according to claim 1, wherein in the (B) step, the powder compact is detached from the mold, and from the first and second punches, and thereby released from the mold, and in the (C) step, an electric current is fed through the powder compact through first and second terminals and the first and second punches.

3. The current assisted sintering method according to claim 1, wherein in the (C) step, each particle of the powder in the powder compact is sintered or diffusion-bonded by at least one of heat generated between each pair of particles, heat generated from inside of each particle, and heat transmitted from outside of particles through thermal conduction.

4. The current assisted sintering method according to claim 1, wherein when a first powder compact is molded in the (A) step, in parallel therewith, an electric current is fed through a second powder compact different from the first powder compact so that a sintered compact can be formed therefrom in the (C) step.

5. The current assisted sintering method according to claim 1, wherein in the (A) step, a packing density of the powder is changed from a density lower than 60% to 60% or higher, and in the (C) step, the packing density of the powder is kept at 60% or higher.

* * * * *